United States Patent [19]

Ritter

[11] 4,176,768

[45] Dec. 4, 1979

[54] PAINT CAN CORNER FILLER

[76] Inventor: John C. Ritter, 12645 Duchess, Detroit, Mich. 48224

[21] Appl. No.: 917,913

[22] Filed: Jun. 22, 1978

[51] Int. Cl.[2] ..... B67D 3/00

[52] U.S. Cl. ..... 222/564; 222/569

[58] Field of Search ..... 222/564, 569, 570; 220/85 SP, 90, DIG. 21

[56] References Cited

U.S. PATENT DOCUMENTS

| | | | |
|---|---|---|---|
| 1,765,409 | 6/1930 | Fitzgerald | 222/569 |
| 2,722,347 | 11/1955 | Henke | 220/90 X |
| 2,732,108 | 1/1956 | Haddad | 222/564 |
| 3,309,000 | 3/1967 | Haverstick | 222/569 |
| 3,356,266 | 12/1967 | Pinter, Jr. | 222/570 X |

*Primary Examiner*—Allen N. Knowles

*Attorney, Agent, or Firm*—Basile and Weintraub

[57] ABSTRACT

A corner filler for the inside corner of the openable end of paint containers. The corner filler is made from resilient material in the form of a ring. The thickness of the ring is sufficient to fill the space between the inside wall of the container and the inside surface of the outer edge of the sealing lip. The corner filler as defined allows all of the paint to be poured from the container and makes the container easier to clean.

2 Claims, 5 Drawing Figures

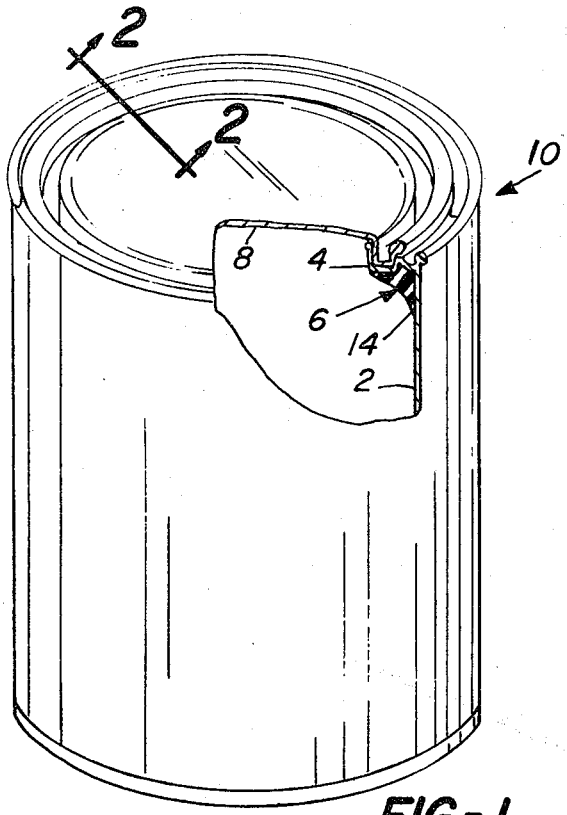
FIG-1
FIG-2
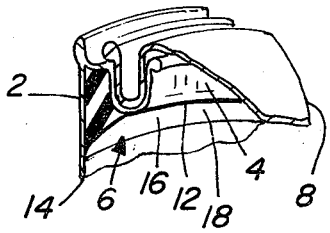
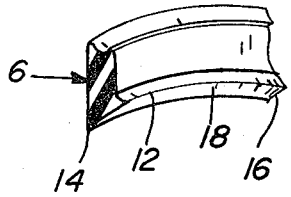
FIG-3
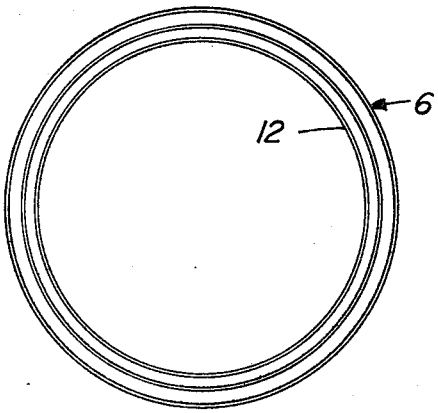
FIG-4
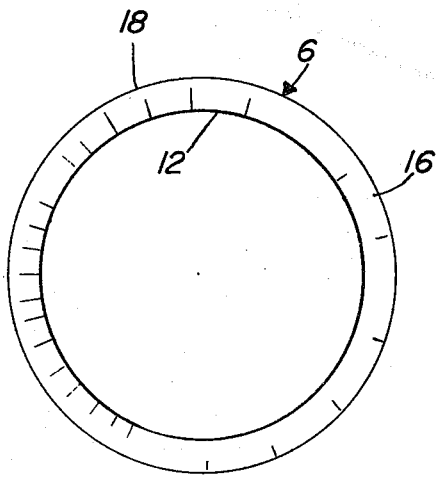
FIG-5

PAINT CAN CORNER FILLER

BACKGROUND OF THE INVENTION

I. Field of the Invention

The present invention relates generally to a corner filler for the inside corner of the openable end of fluid containers of the type having a removable and resealable lid such as paint containers.

II. Description of the Prior Art

Prior art discloses corner fillers that at best partly fill the space between the sealing lip and the outer wall of the container. These generally are part of a pouring spout and/or a closure member and are effective only when the spout is attached to the can. None of the prior art shows a resilient member for completely filling the space from inside between the sealing lip and the outer wall of the container. U.S. Pat. No. 1,765,409; No. 2,520,549; No. 2,812,866 and No. 3,124,282 constitute the closest art to the present invention.

PRIOR ART STATEMENT

In the opinion of the applicant, the aforementioned prior art constitutes the closest art known to applicant.

SUMMARY OF THE INVENTION

The present invention, which will be described subsequently in greater detail, comprises a ring of resilient material disposed inside the container between the outer wall and the outer edge of the sealing lip. The ring has a slightly larger diameter than the inside of the can so it can sealingly engage the outer wall of the container. The ring has a cross sectional shape allowing it to snugly fill the space between the inside of the outer wall of the container and the inside of the outer edge of the sealing lip. The ring has a length of about two times the depth of the sealing lip and an acute angle between the outside diameter of the seal and its lower surface. This allows the complete emptying of the container of its contents when pouring. No paint can accumulate between the lip and outer wall and the container can be easily cleaned and prepared for carrying other fluids without contamination with the first fluid carried therein. Since no paint is allowed to enter the space between the sealing lip and outer wall there is no chance of paint hardening there which would be impossible to remove without ruining the container.

It is, therefore, an object of this invention to provide a corner filler for the space between the inside of the outer wall and the sealing lip of a liquid carrier with a resealable lid. A further object of the present invention is to provide means for emptying the container of all of its contents by pouring, and to allow easy cleaning of the container.

Other objects, advantages, and applications of the present invention will become apparent to those skilled in the art of liquid containers when the accompanying description of one example of the best mode contemplated for practicing the invention is read in conjunction with the accompanying drawing.

BRIEF DESCRIPTION OF THE DRAWING

The description herein makes reference to the accompanying drawing wherein like numerals refer to like parts throughout the several views and in which:

FIG. 1 is a perspective view of a liquid carrier with a portion of the container cut away to show the lid, sealing lip, and the corner filler in place;

FIG. 2 is an enlarged perspective view of a section through 2—2 of FIG. 1;

FIG. 3 is a perspective view of the corner filler in FIG. 2 removed from the container;

FIG. 4 is a top plan view of the corner filler;

FIG. 5 is a bottom plan view of the corner filler.

DESCRIPTION OF THE PREFERRED EMBODIMENT

Referring now to the drawing, and in particular FIGS. 1 and 2, wherein there is illustrated one example of the present invention in the form of a liquid carrier 10 having a side wall 2 with a top sealing lip 4 and a corner filler 6. Lid 8 sealingly engages sealing lip 4 for sealing the lid to the carrier. Corner filler 6 comprises a ring sealingly engaging the inner surface of side wall 2. The space between the side wall 2 and the outer surface of sealing lip 4 is snugly filled by the corner filler 6 which extends radially inward. Corner filler 6 terminates at its innermost point in a sharp corner 12 when it has covered approximately half of the radial thickness of sealing lip 4. The outer diameter 18 of corner filler 6 extends for approximately twice the depth of sealing lip 4. The bottom edge of outer diameter 18 terminates in an oblique angle 14 where it joins lower wall 16. Lower wall 16 has a concave surface and extends from the lower edge of outer diameter 18 to sharp corner 12.

It should be understood by those skilled in the art that, although a circular container is disclosed, other containers of different shape may be utilized in conjunction with the inventive corner filler as the corner filler may have its shape varied so as to accommodate such varying shaped cans; and while the present invention is described in conjunction with a paint can and uses associated with such paint cans, it should be understood that the inventive corner filler may be used in conjunction with other types that may be construed as a container for other fluids or liquid commodities such as enamel, varnish, plastic resins, thinner, solvents, and so forth.

The use of the paint can corner filler adds to the shelf life of water base paints. It is understood by those skilled in the art of injection molding that the present invention can be made from a variety of materials including polyethylene, polyurethane, polypropylene, and polyvinylchloride.

What is claimed is as follows:

1. A corner filler for the inside corner of the openable end of liquid carriers comprising:

a ring of resiliant material said ring having an outside diameter larger than the inside diameter of said carrier to sealingly engage said inside diameter, one end of said ring having a thickness and shape approximating the space between the inside wall of said carrier and the inside wall of the outer edge of said carriers sealing lip, and is snugly received therein, the inside wall of said one end following the contour of said space axially toward the other end and radially inward, terminating in a circular sharp edge when the bottom of said sealing lip is half covered radially;

said outside diameter extends axially from said one end for approximately two times the depth of said sealing lip terminating in an oblique corner at said other end, said oblique corner and said circular sharp edge are connected by a slightly concave surface.

2. A corner filler for the inside corner of the openable end of liquid carriers as defined in claim 1 wherein an adhesive is used to hold said corner filler in place.

* * * * *